United States Patent [19]

Kamata

[11] Patent Number: 5,048,129

[45] Date of Patent: Sep. 17, 1991

[54] HELMET FOR RIDING VEHICLE

[75] Inventor: Eitaro Kamata, Tokyo, Japan

[73] Assignee: Shoei Kako Kabushiki Kaisha, Tokyo, Japan

[21] Appl. No.: 627,457

[22] Filed: Dec. 14, 1990

[30] Foreign Application Priority Data

Aug. 22, 1990 [JP] Japan ..... 2-87798[U]

[51] Int. Cl.[5] ..... A42B 1/08

[52] U.S. Cl. ..... 2/424; 2/428

[58] Field of Search ..... 2/9, 10, 410, 424, DIG. 5, 2/5, 427, 428, 430

[56] References Cited

U.S. PATENT DOCUMENTS

| | | | |
|---|---|---|---|
| 4,070,712 | 1/1978 | v.d. Marwitz | 2/10 |
| 4,556,994 | 12/1985 | Kawasaki et al. | 2/424 |
| 4,581,775 | 4/1986 | Nava | 2/424 |

FOREIGN PATENT DOCUMENTS

| | | | |
|---|---|---|---|
| 2918587 | 11/1980 | Fed. Rep. of Germany | 2/424 |
| 3227410 | 12/1983 | Fed. Rep. of Germany | 2/428 |
| 8704323 | 7/1987 | PCT Int'l Appl. | 2/410 |
| 2004178 | 3/1979 | United Kingdom | 2/424 |

*Primary Examiner*—Werner H. Schroeder
*Assistant Examiner*—Michael A. Neas
*Attorney, Agent, or Firm*—Armstrong, Nikaido, Marmelstein, Kubovcik, & Murray

[57] ABSTRACT

In a helmet for riding a vehicle comprising a cap body, a shield plate vertically turnably supported to both left and right side surfaces of the cap body to open or close a window of a front surface of the cap body, and a seal lip sealed with an inner surface of the shield plate at its closed position and integrally formed with an edge member attached to the peripheral edge of a window of the cap body, an upper seal lip directed at an end thereof downwardly being integrally formed with an upper side portion of the edge member along an upper edge of the window of the cap body, an upper drain groove extending along the upper edge of the window being provided on an upper surface of a base portion of the upper seal lip. The seal lip is prevented from reversely turning when the shield plate is turned downwardly to obtain its sealing function and to improve its drainage.

4 Claims, 4 Drawing Sheets

HELMET FOR RIDING VEHICLE

BACKGROUND OF THE INVENTION

1. FIELD OF THE INVENTION

The present invention relates to a helmet for riding a vehicle, and more particularly, to an improvement in a helmet comprising a cap body with a shield plate being vertically turnably supported on left and right side surfaces of said cap body to open and close a window formed in a front surface of the cap body, and a seal lip being formed continuously from an edge member attached to a peripheral edge of the window for tightly contacting with an inner surface of the shield plate in a closed position thereof.

2. DESCRIPTION OF THE PRIOR ART

In a conventional helmet of this type, outer ends of all of seal lips are formed to direct outward with respect to a window, a drain groove is defined between the seal lips and an edge member. Therefore, the helmet is used in the rain, rainwater flowing down on the surface of a cap body is received by the drain groove to prevent the rainwater from entering the window (for example, see Japanese Utility Model Publication Kokoku No. 1-16743).

In the helmet as described above, since an outer end of the portion of the seal lip along the upper edge of the window is directed upward, when a shield plate is turned downward, the shield plate might be slidably rubbed with the seal lip having the outer end upwardly directed. The seal lip is reversely turned downwardly by the slidable friction to not only damage its sealing function but to vanish a drain groove, and thus, the rainwater flowing down on the surface of the cap body may enter the window when the helmet is used in the rain.

SUMMARY OF THE INVENTION

The present invention has been accomplished with such circumstances in view. It is an object of the present invention to provide a helmet of the type described above, in which a seal lip is prevented from being reversely turned when a shield plate is turned downwardly to obtain its sealing function and preferable drainage is provided.

To accomplish the above object, according to the present invention, there is provided a helmet in which the seal lip includes an upper seal lip portion having a tip end directed downward, the upper seal lip portion being formed continuously from an upper side portion of the edge member along an upper edge of the window and being provided at an upper surface of a base portion thereof with an upper drain groove which is extended along the upper edge of the window.

With such a construction, even if the inner surface of the shield plate is slidably rubbed with the upper seal lip when the shield plate is turned downwardly, the outer end of the upper seal lip is directed downward. Thus, the seal lip is not reversely turned to maintain the close contact state with the inner surface of the shield plate, thereby reliably exhibits its sealing function.

Since the drain groove is formed on the upper surface of the base portion of the upper seal lip, the rainwater flowing down on the surface of the cap body is received by the drain groove to prevent the water from entering the window when the helmet is used in the rain.

These and other objects and features of the present invention will become apparent from the following detailed description in conjunction with the attached drawings:

BRIEF DESCRIPTION OF THE DRAWINGS

Figures illustrate one embodiment of the present invention, wherein.

DESCRIPTION OF THE PREFERRED EMBODIMENT

The present invention will now be described by way of embodiment with reference to the accompanying drawings.

Figure 1:
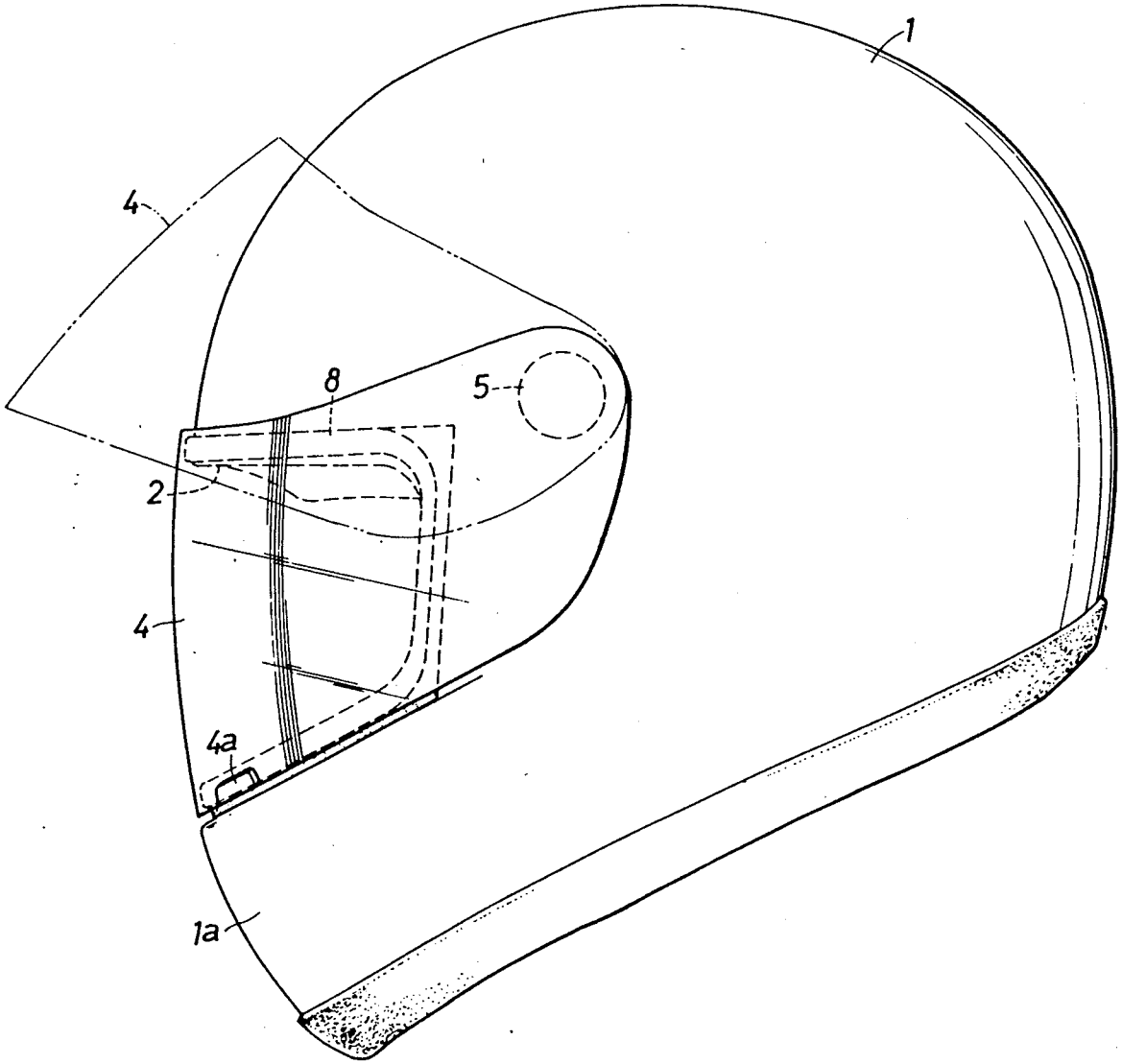
FIG. 1 is a side view of a helmet on which a shield plate is mounted.
Figure 2:
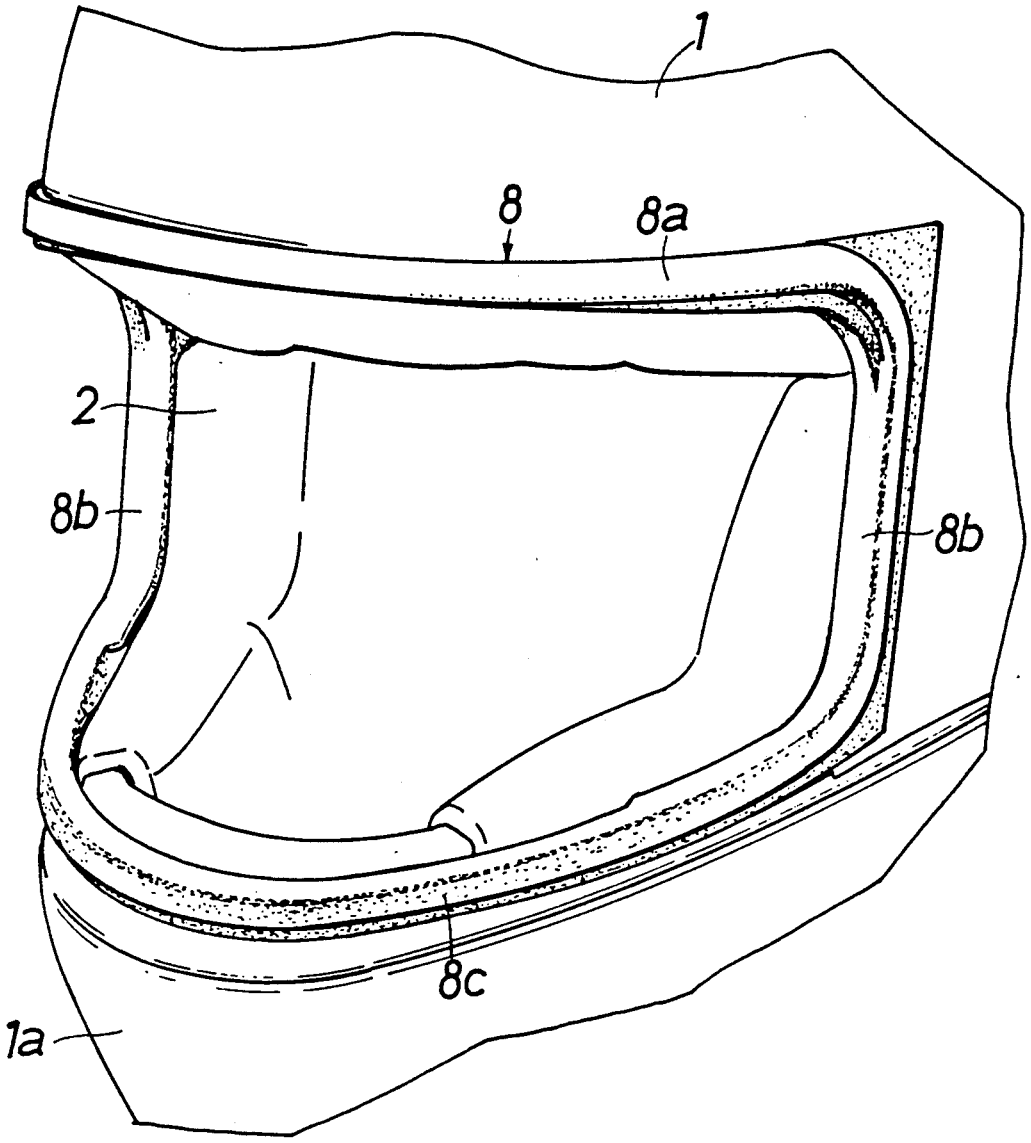
FIG. 2 is a perspective view of the helmet in a state that the shield plate is removed.

Referring first to FIGS. 1 and 2, a cap body 1 of a helmet is formed in a full-face type having a chin cover portion la directly below a window 2 in a front surface.

A shield plate 4 made of transparent synthetic resin for opening and closing a window 2 is attached at both left and right opposite ends thereof to both left and right side surfaces of the cap body 1 through pivot sections 5. If the shield plate 4 is turned upwardly by holding a knob 4*a* at its lower edge, the window 2 can be opened, whereas if the shield plate 4 is turned downwardly, the window can be closed.

Figure 3:
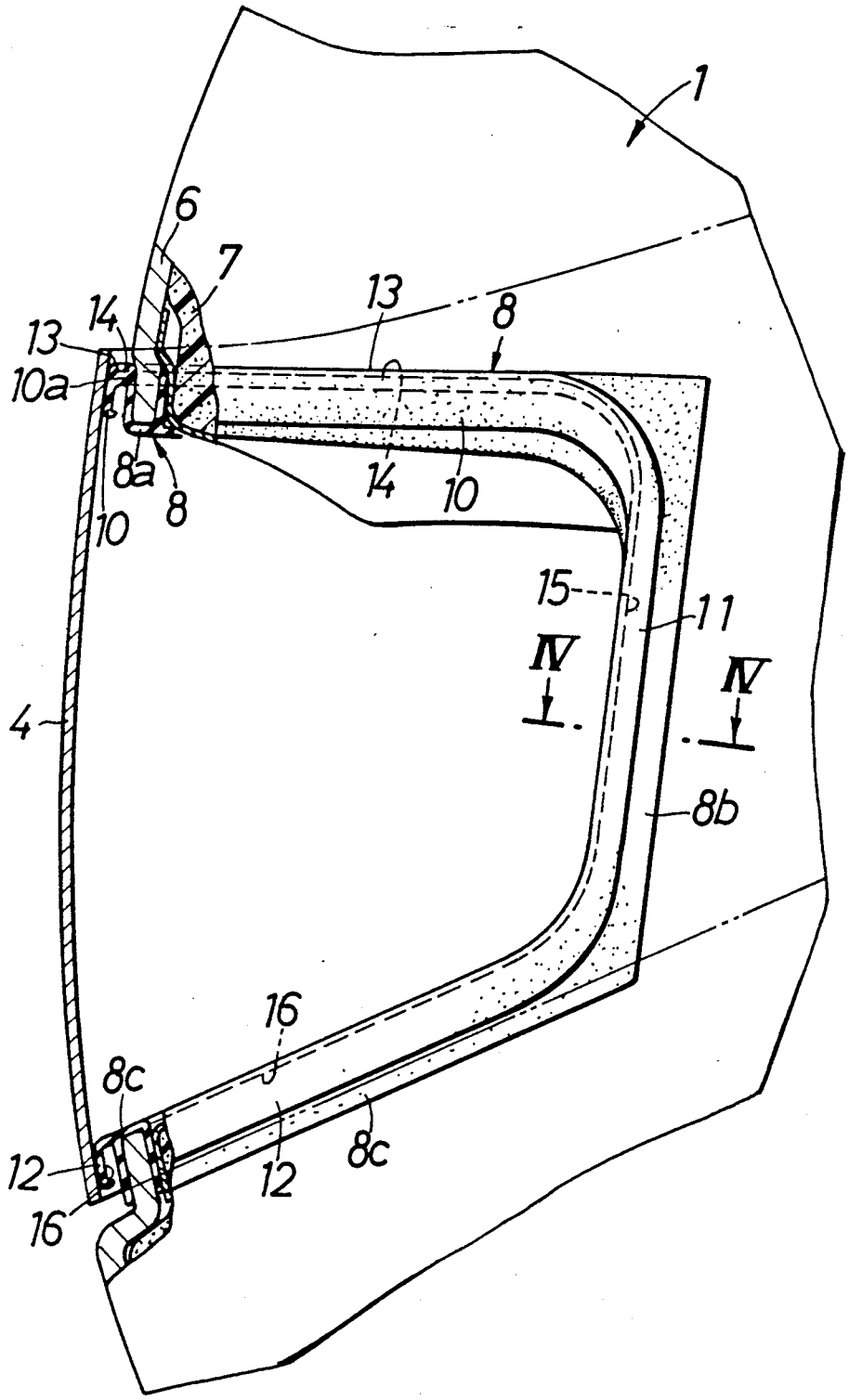
FIG. 3 is a partially longitudinal sectional enlarged view of an essential portion of FIG. 1.

As shown in FIG. 3, the cap body 1 is composed of a shell 6 made of an FRP (fiber reinforced plastic), and an impact absorption liner 7 made of foamable styrol brought into close contact with an inner surface of the shell 6. A channel-like edge member 8 made of rubber is adhesively fitted to the peripheral edge of the window 2 of the shell 6.

As shown in FIG. 2, the edge member 8 is formed in an endless state and comprises an upper side portion 8*a*, left and right side portions 8*b* and a lower portion 8*c* corresponding to an upper edge portion, left and right side edge portions and a lower edge portion of the window 2, respectively.

As shown in FIG. 3, an upper seal lip 10 projecting from an outer surface of the upper side portion 8*a* with an outer end of the seal lip 10 directing downward is integrally formed with the upper side portion 8*a* of the edge member 8. A base portion 10*a* of the seal lip 10 is formed thicker than the rest portion and has a relatively large deflecting rigidity. A strip of projection 13 is integrally formed on the upper surface of the base portion 10*a* for defining an upper drain groove 14 between the front face of the edge member 8. The projection 13 is formed so that its projecting length is shorter than the upper seal lip 10 and its outer end is not brought into contact with the inner surface of the shield plate 4 in its closed position.

Figure 4:
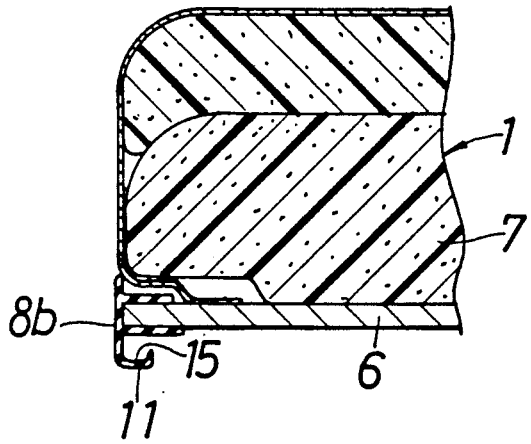
FIG. 4 is a sectional view taken along the line IV—IV of FIG. 3.

As shown in FIG. 4, side seal lips 11 projecting from outer surfaces of the left and right side portions 8*b* with outer ends of the seal lips 11 directing rearward is integrally formed with both left and right side portions 8*b* of the edge member 8. Side drain grooves 15 are defined between the side seal lips 11 and an outer surface of the edge member 8. The side seal lips 11 are connected continuously to the projection 13 to communicate the side drain groove 15 with the upper drain groove 14.

Referring again to FIG. 3, a lower seal lip 12 projecting from an outer surface of the lower side portion 8*c* with an outer end of the seal lip 12 directing downward is integrally formed with the lower side portion 8*c* of the edge member 8. A lower drain groove 16 is defined between the outer surface of the edge member 8 and the lower seal lip 12. The lower seal lip 12 is connected continuously to the side seal lip 11 to communicate the lower drain groove 16 with the side drain groove 15.

The upper seal lip 10, the left and right side seal lips 11 and the lower seal lip 12 are continuously brought into close contact the inner surface of the shield plate 4 under a suitable pressure contact force when the shield plate 4 is closed.

Description will now be made of the operation of this embodiment.

When the shield plate 4 is turned downwardly to close the window 2 of the cap body 1, the inner surface of the shield plate 4 is brought into close contact with all the seal lips 10, 11 and 12 of the edge member 8. In this case, since the upper seal lip 10 is directed at its outer end downwardly and its base portion 10*a* is thick with relatively large deflecting rigidity, the seal lips are not reversely turned even by a slidable friction with the inner surface of the shield plate 4, and can maintain their proper attitudes.

Since the projection 13 for defining the upper drain groove 14 between the edge member 8 is not contacted at its leading end with the inner surface of the shield plate 4, it is not reversely turned downwardly, thereby securing the upper drain groove 14.

On the other hand, since the side seal lips 11 are directed at their outer ends rearwardly and the lower seal lip 12 is directed at its outer downwardly, the seal lips 11 and 12 are not, when the shield plate 4 is turned downwardly, reversely turned even by a slide friction with the shield plate 4, as in the conventional helmet.

As described above, all the seal lips 10, 11 and 12 can be continuously brought into contact with the inner surface of the shield plate 4 to reliably close the window 2. When raining, rainwater flowing down on the surface of the cap body 1 toward the window 2 are received by the upper drain groove 14, and guided to the lower drain groove 16 via the side drain grooves 15 to be drained under the window 2, thereby preventing the water from entering the window 2.

The case that the present invention is applied to a full-face type helmet has been described. However, the present invention can also be applied to a jet type helmet without the chin cover portion 1*a*. That is, the edge member 8 of such case is not of endless type without the lower side portion 8*c*.

What is claimed is:

1. A helmet for riding a vehicle comprising: a cap body with a shield plate, means for vertically turnably supporting rail shield plate on left and right side surfaces of said cap body to open and close a window formed in a front surface of the cap body, and a seal lip being formed continuously from an edge member attached to a peripheral edge of the window for tightly contacting with an inner surface of the shield plate in a closed position thereof, wherein said seal lip includes an upper seal lip portion having a tip end directed downward, said upper seal lip portion being formed continuously from an upper side portion of the edge member along an upper edge of the window and being provided at an upper surface of a base portion of said upper seal lip portion with an upper drain groove which extends along the upper edge of the window.

2. A helmet for riding a vehicle according to claim 1, wherein the base portion of said upper seal lip portion is formed larger in thickness than the rest of said seal lip to increase a flexing rigidity of the base portion.

3. A helmet for riding a vehicle according to claim 1 or 2, wherein said upper drain groove is defined between a strip of projection integrally formed with the upper surface of the base portion of said upper seal lip portion and a front face of said edge member.

4. A helmet for riding a vehicle according to claim 3, wherein said seal lip further includes a side seal lip portion formed continuously from a side portion of the edge member along a side edge of the window for defining a side drain groove between a side seal lip portion and an outer surface of the edge member, said side seal lip portion being connected with said projection so as to bring said upper and side drain grooves into communication with each other.

* * * * *

UNITED STATES PATENT AND TRADEMARK OFFICE

CERTIFICATE OF CORRECTION

PATENT NO. : 5,048,129

DATED : September 17, 1991

INVENTOR(S) : Eitaro Kamata

It is certified that error appears in the above-identified patent and that said Letters Patent is hereby corrected as shown below:

Claim 1, column 4, line 12, delete "rail", and insert therefor --said--.

Signed and Sealed this

Second Day of March, 1993

*Attest:*

STEPHEN G. KUNIN

*Attesting Officer*

*Acting Commissioner of Patents and Trademarks*